US006217313B1

(12) United States Patent
Luo

(10) Patent No.: US 6,217,313 B1
(45) Date of Patent: Apr. 17, 2001

(54) CHILDPROOF BARBECUE LIGHTER

(76) Inventor: Ying Wen Luo, Rm. 1510 Nan Fung Centre, 264-298 Castle Peak Road, Tsuen Wan, N.T., Hong Kong (CN)

( * ) Notice: Subject to any disclaimer, the term of this patent is extended or adjusted under 35 U.S.C. 154(b) by 0 days.

(21) Appl. No.: 09/624,360

(22) Filed: Jul. 24, 2000

(51) Int. Cl.[7] ..... F23Q 3/01
(52) U.S. Cl. ..... 431/153; 431/255
(58) Field of Search ..... 431/153, 255

(56) References Cited

U.S. PATENT DOCUMENTS 5,145,358 * 9/1992 Shike et al. ..... 431/153
5,326,256 * 7/1994 Shike et al. ..... 431/255
5,462,432 * 10/1995 Kim ..... 431/153

* cited by examiner

*Primary Examiner*—Ira S. Lazarus
*Assistant Examiner*—Sara Clarke
(74) *Attorney, Agent, or Firm*—Raymond Y. Chan; David and Raymond Patent Group

(57) ABSTRACT

A childproof barbecue lighter includes a lock button having a locking arm downwardly extended to a stopper in a pusher cavity for blocking up a pusher button from being pushed downwardly so as to lock up the pusher button from ignition. The lock button is movable with respect to the pusher button wherein the lock button is arranged to drive the locking arm to move offset from the stopper in such a manner the pusher button is capable of being pushed downwardly to ignite the barbecue lighter.

11 Claims, 4 Drawing Sheets

CHILDPROOF BARBECUE LIGHTER

BACKGROUND OF THE PRESENT INVENTION

1. Field of Invention

The present invention relates to a barbecue lighter, and more particularly to a childproof barbecue lighter for preventing under age children from the usage of the barbecue lighter.

2. Description of Related Arts

Most accidental fires were started by the ignorant usage of the lighter, especially by the young children. So, nowadays, both U.S. government and U.S. Consumer Product Safety Commission demand a safety device in every lighter including the barbecue lighter to prevent unwanted ignition accidentally or by a child.

Conventional barbecue lighter comprises a lock switch for locking up the ignition trigger so as to prevent the ignition trigger of the lighter from accidentally being depressed thereby causing an unintended ejection. To ignite the lighter, user must turn the lock switch aside to unlock the safety switch. User may repeat the step of unlocking the lock switch many times until he or she ignites a fire in certain condition. However, if the user forgets to re-lock the safety switch after ignition, the lock switch will not be functioned.

Moreover, such barbecue lighter with the lock switch employed cannot stop children from igniting it. Usually, the lock switch is simply placed at the side of the lighter. In most cases, children can easily figure out how to ignite theses barbecue lighters by switching the lock switch to its unlock position. The adults may frequently forget to re-lock the lock switch after each ignition. So, the existing barbecue lighters are not really safe enough to prevent under age children from using the barbecue lighters.

SUMMARY OF THE PRESENT INVENTION

A main object of the present invention is to provide a childproof barbecue lighter for preventing under age children from using the barbecue lighter.

Another object of the present invention is to provide a childproof barbecue lighter wherein the barbecue lighter is normally maintained in a locking position, so as to prevent any unwanted ignition of the lighter.

Another object of the present invention is to provide a childproof barbecue lighter wherein the ignition of the barbecue lighter of the present invention requires a simple single-action operation by an adult's finger instead of or in addition to the conventional double-action operation.

Another object of the present invention is to provide a childproof barbecue lighter wherein the locker device does not require to change the original structural design of the barbecue lighter, so as to minimize the manufacturing cost of incorporating the locker device with every conventional barbecue lighter having a pusher button.

Accordingly, in order to accomplish the above objects, the present invention provides a barbecue lighter, comprising:

a casing having a liquefied gas cavity and a pusher cavity provided therein;

a liquefied gas container being received in the liquefied gas cavity to provide liquefied gas through a gas emitting nozzle mounted on top of the liquefied gas container;

an elongated nozzle tube extended from the casing and contains a gas tube therein, wherein the gas tube is extended from the gas emitting nozzle to a distal end of the elongated nozzle tube to form an ignition tip;

a piezoelectric unit, which is disposed in the pusher cavity of the casing for generating piezoelectricity, comprising a movable operating part extended therefrom and a spark generating tip which is extended to the distal end of the elongated nozzle tube to produce sparks towards the ignition tip to ignite the gas emitted from the ignition tip;

a pusher button which is disposed in the pusher cavity of the casing in a vertically movable manner and attached on the movable operating part of the piezoelectric unit so as to operatively connect to the piezoelectric unit, wherein the pusher button is also operatively connected to the gas emitting nozzle via a gas lever; and a locker device being installed inside the pusher cavity of the casing for blocking up the pusher button in a downward movable manner so as to lock up the pusher button for ignition, wherein the locker device comprises a lock button being movably supported on the pusher button which has a through slot provided thereon, the lock button being slidably fitted in the through slot in such a manner that the lock button is movable with respect to the pusher button, the lock button further comprising a locking arm integrally and downwardly extended into the pusher cavity through the through slot in such a manner that the lock button is arranged to drive the locking arm to move from a normally locking position to an unlocked position, a stopper which is provided in the pusher cavity and positioned right under the locking arm of the locker device while the locker device is in the locking position so that the locker device is blocked by the stopper for any downward movement so as to stop the pusher button from any downward movement by blocking up the locking arm of the locker device, and a resilient element, which is disposed in the pusher cavity, for applying an urging pressure against the locking arm, so as to normally retain the locker device at the locking position, wherein at the locking position, the locking arm is downwardly extended and stopped by the stopper for blocking up the pusher button from being pushed downwardly so as to lock up the pusher button from ignition, and that at the unlocked position, the locking arm is moved offset from the stopper such that the pusher button is capable of being pushed downwardly to ignite the childproof barbecue lighter.

Whereby, in order to ignite the childproof barbecue lighter, an adult user's must move the locker device from the normal locking position to the unlocked position by sliding the lock button to drive the locking arm to move away from the stopper, i.e. the side wall of the piezoelectric unit. The user has to apply holding force to the lock button so as to retain the locker device in such unlocked position and then, at the same time, the user must further apply a downward pushing force to push down the pusher button to compress the piezoelectric unit for striking sparks and ignite the barbecue lighter. When the pushing force applied on the pusher button is released, the compressed piezoelectric unit will rebound to its original condition which pushes the pusher button back to its original position. Automatically, the compressed resilient element will also rebound and push the locking arm back to its original locking position.

DETAILED DESCRIPTION OF THE PREFERRED EMBODIMENT

Figure 1:
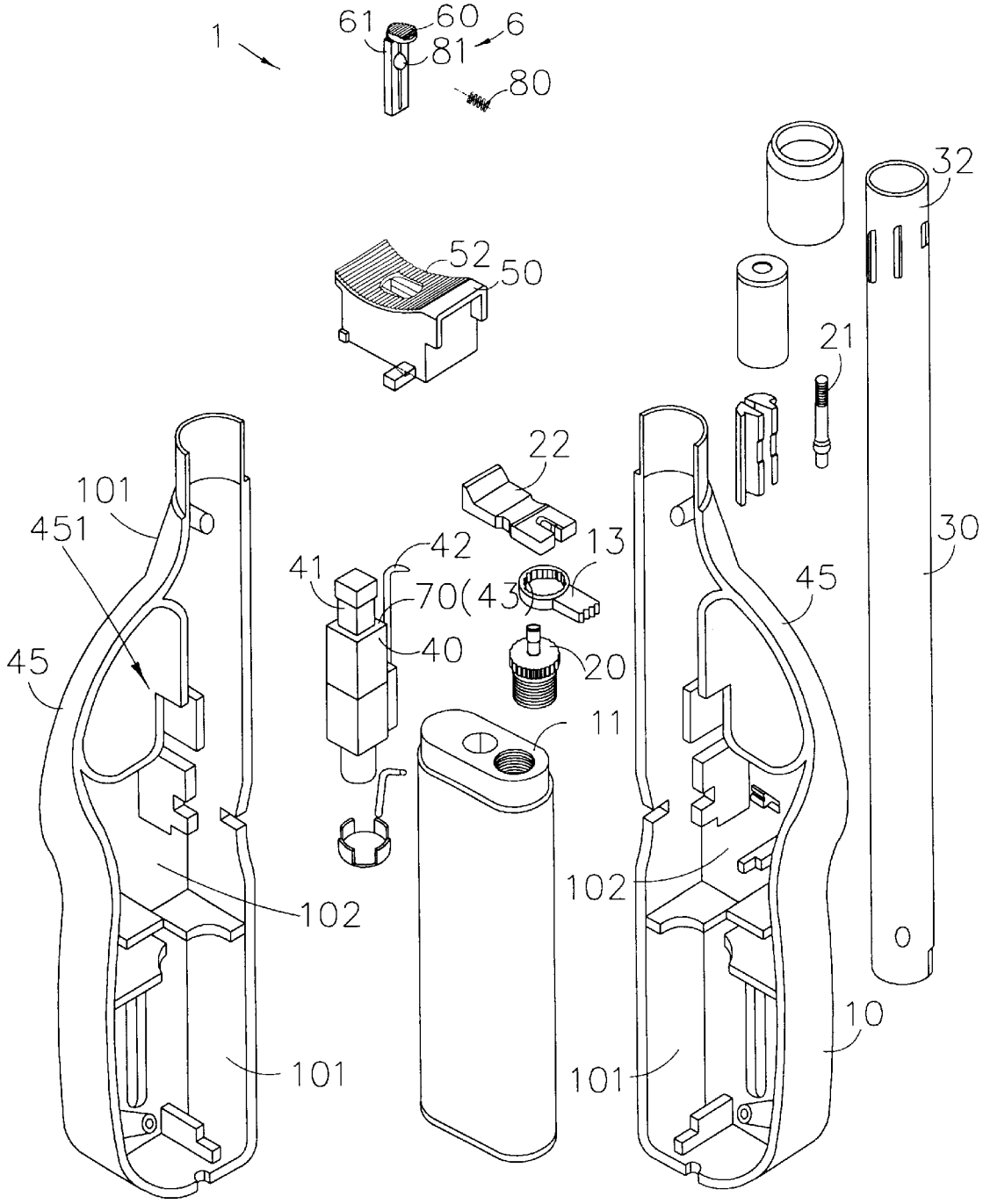
FIG. 1 is an exploded perspective view of a childproof barbecue lighter according to a preferred embodiment of the present invention.
Figure 2:
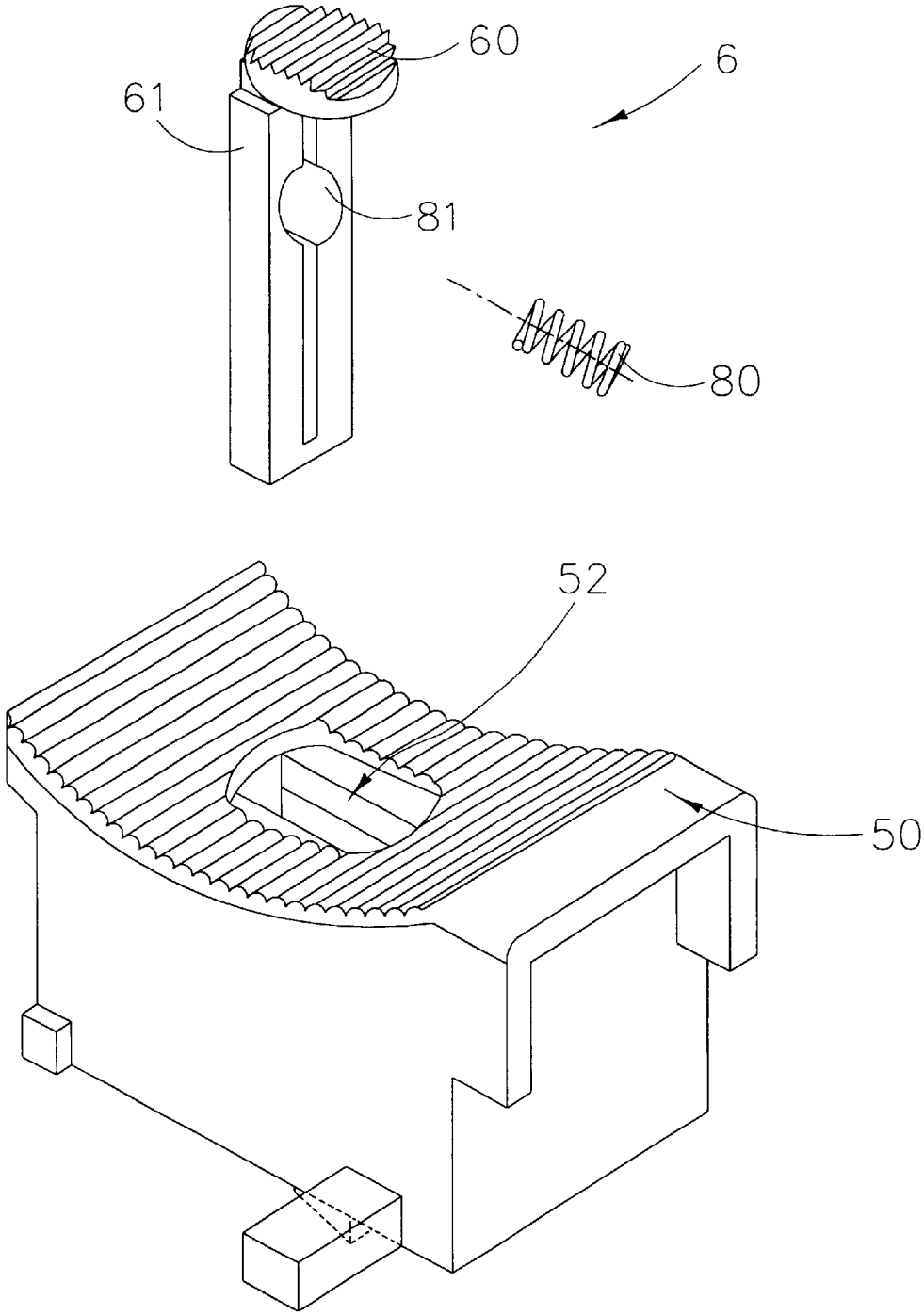
FIG. 2 is a perspective view of the childproof barbecue lighter according to the above preferred embodiment of the present invention, illustrating the lock button being mounted on the pusher button.

Referring to FIGS. 1 and 2 of the drawings, a childproof barbecue lighter 1 according to a preferred embodiment of the present invention is illustrated. The childproof barbecue lighter 1 comprises a casing 10 having a liquefied gas cavity 101 and a pusher cavity 102 provided therein, wherein a liquefied gas container 11 is received in the liquefied gas cavity 101 to provide liquefied gas through a gas emitting nozzle 20 mounted on top of the liquefied gas container 11.

The childproof barbecue lighter 1 further comprises an elongated nozzle tube 30, a piezoelectric unit 40 and a pusher button 50. The elongated nozzle tube 30 is extended from the casing 10 and contains a gas tube 31 therein. The gas tube 31 is extended from the gas emitting nozzle 20 to a distal end 32 of the elongated nozzle tube 30 to form an ignition tip 21.

The piezoelectric unit 40, which is disposed in the pusher cavity 102 of the casing 10 for generating piezoelectricity, comprises a movable operating part 41 extended therefrom and a spark generating tip 42. The spark generating tip 42 is extended to the distal end 32 of the elongated nozzle tube 30 to produce sparks towards the ignition tip 21 to ignite the gas emitted from the ignition tip 21.

The pusher button 50 is disposed in the pusher cavity 102 of the casing 10 in a vertically movable manner and attached on the movable operating part 41 of the piezoelectric unit 40 so as to operatively connect to the piezoelectric unit 40. The pusher button 50 is also operatively connected to the gas emitting nozzle 20 via a gas lever 22. Accordingly, when the pusher button 50 is pushed downward, the movable operating part 41 of the piezoelectric unit 40 is compressed for generating piezoelectricity through and out the spark generating tip 42. At the same time, the gas level 22 is simultaneously pressed by the pusher button 50 to release gas through the gas emitting nozzle 20, the gas tube 31 and the ignition tip 21, in which the releasing gas will be ignited by striking spark transmitted from the spark generating tip 42.

The casing 10 generally further has a finger guide 45 extended around the pusher button 50 so as to define a finger loop 451 therein fitting a user's finger engaged therethrough to guide and press the pusher button 50. Also, a flame regulator 13 is encircled the gas emitting nozzle 20 and controlled the flow of gas through the gas emitting nozzle 20.

As shown in FIGS. 1 to 4, the childproof barbecue lighter 1 further comprises a locker device 6, which comprises a lock button 60, a stopper 70, and a resilient element 80. The locker device 6 is installed inside the pusher cavity 102 of the casing 10 for blocking up the pusher button 50 in a downward movable manner so as to lock up the pusher button 50 for ignition.

Figure 3:
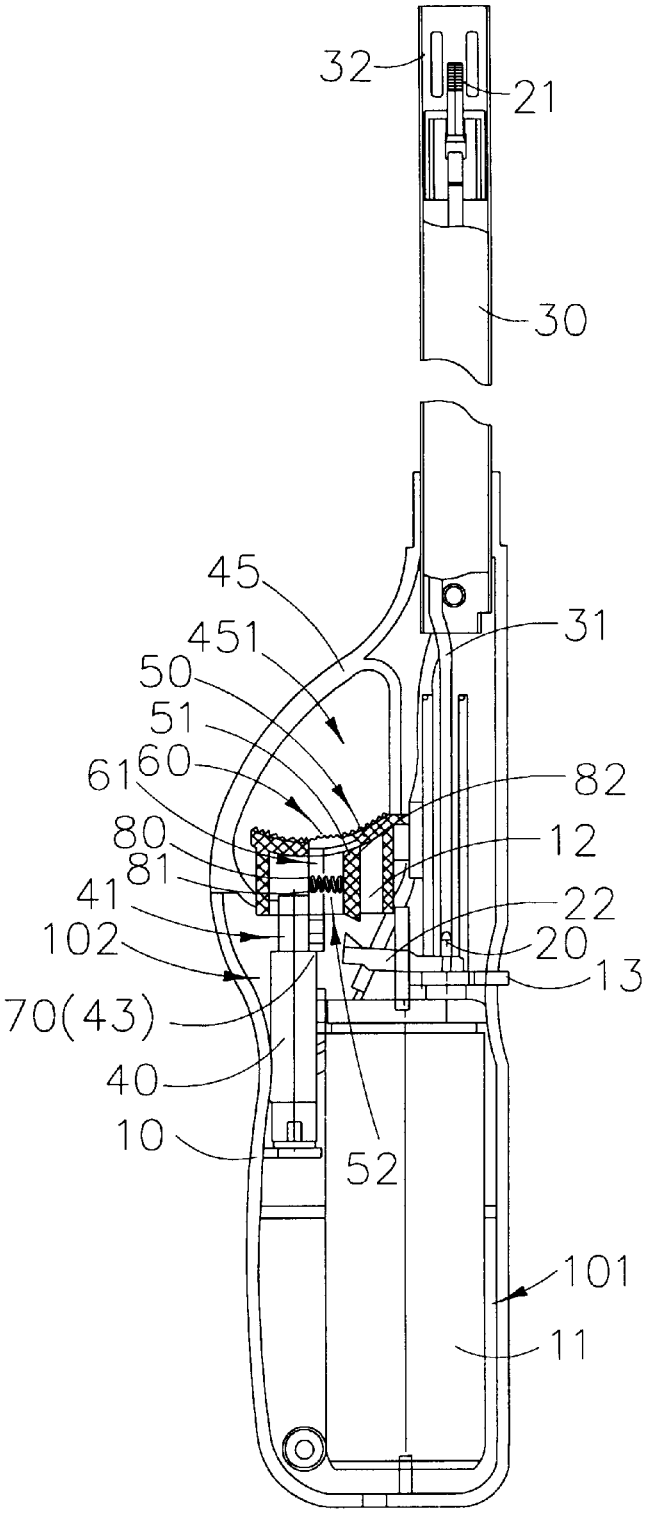
FIG. 3 is a partially sectional view of the childproof barbecue lighter, during a locking condition, according to the above preferred embodiment of the present invention.
Figure 4:
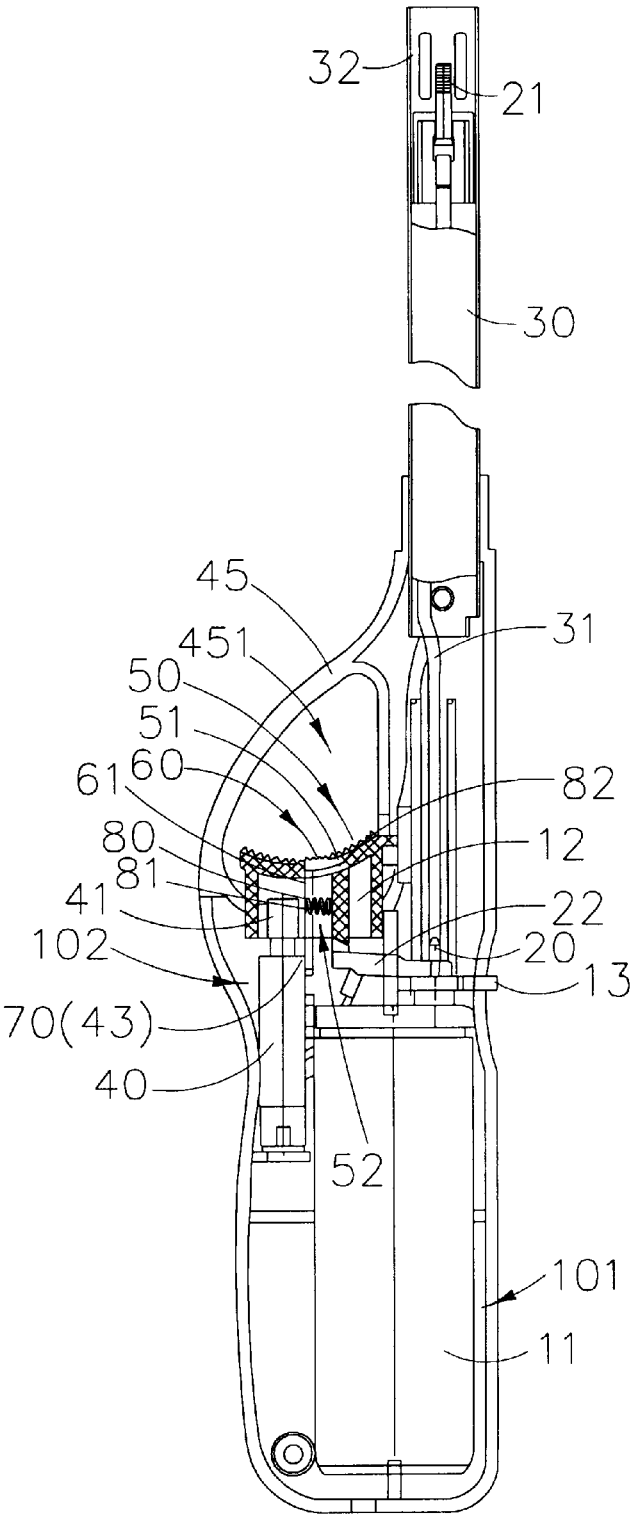
FIG. 4 is a partially sectional view of the childproof barbecue lighter, during an unlocking condition, according to the above preferred embodiment of the present invention.

The lock button 60 is movably supported on the pusher button 50 which has a through slot 52 provided thereon. The lock button 60 is slidably fitted in the through slot 52 in such a manner that the lock button 60 is movable with respect to the pusher button 50. The lock button 60 further comprises a locking arm 61 integrally and downwardly extended into the pusher cavity 102 through the through slot 52 in such a manner that the lock button 60 is arranged to drive the locking arm 61 to move from a normally locking position (as shown in FIG. 3) to an unlocked position (as shown in FIG. 4).

The locker device 6 is arranged to construct as a part of the pusher button 50 in such a manner that the locker device 6 and the pusher button 50 are movable together in vertical direction. In other words, when the locker device 6 is locked up at the locking, the pusher button 50 is blocked and cannot be pushed downward to compress the piezoelectric unit 40 for generating piezoelectricity. When the lock device 6 is unlocked to the unlocked position, the blocking of the pusher button 50 is released and the pusher button 50 and the locker device 6 can be pushed downward together to press the piezoelectric unit 40 for generating piezoelectricity and operate the gas emitting nozzle 20 to release gas.

The stopper 70 is provided in the pusher cavity 102 and positioned right under the locking arm 61 of the locker device 6 while it is in the locking position so that the locker device 6 is blocked by stopper 70 for any downward movement so as to stop the pusher button 50 from any downward movement by blocking up the locking arm 61 of the locker device 6.

The resilient element 80, which is disposed in the pusher cavity 102, for applying an urging pressure against the locking arm 61, so as to normally retain the locker device 6 at the locking position. At the locking position, the locking arm 61 is downwardly extended and stopped by the stopper 70 for blocking up the pusher button 50 from being pushed downwardly so as to lock up the pusher button 50 from ignition, and that at the unlocked position, the locking arm 61 is moved offset from the stopper 70 such that the pusher button 50 is capable of being pushed downwardly to ignite the childproof barbecue lighter 1.

According to the preferred embodiment as shown in FIGS. 3 and 4, in order to minimize the manufacturing cost of the childproof barbecue lighter 1, a side wall 43 of the piezoelectric unit 40 is constructed as the stopper 70. It is because the piezoelectric unit 40 is positioned right below the pusher button 50 so that no additional part is needed to add into the casing 10.

As shown in FIG. 3, according to the preferred embodiment, the locking arm 61 has a predetermined length and is extended downwardly enough from the lock button 60 until its bottom end reaches a top edge of the side wall 43 of the piezoelectric unit 40, so that the side wall 43 substantially blocks up any downwardly movement of the locker device 6 as well as the pusher button 50.

The resilient element 80, according to the preferable embodiment of the present invention, is a compression spring, which is horizontally disposed in the pusher cavity 102 and is provided between the locking arm 61 and an operating wall 51 of the pusher button 50, wherein the operating wall 51 is positioned adjacent to the locking arm 61 and arranged for pressing the gas lever 20 while the pusher button 50 is pushed down. The resilient element 80 is biasing against the locking arm 61 and the operate wall 51 of the pusher button 50 by attaching a first end thereof to the locking arm 61 and a second end thereof to the operating wall 51. Accordingly, the resilient element 80 will normally urge and retain the locking arm 61 in the locking position that the bottom end of the locking arm 61 is extended to rest on the top edge of the side wall 43 of the piezoelectric unit 40, so as to block up any downward movement of the locker device 6 for blocking up the pusher button 50 from being pushed downwardly, so as to lock up the pusher button 50 from ignition.

In other words, the pusher button 50 is always locked up by the locker device 6 from ignition.

Moreover, the locker device 6 of the childproof barbecue lighter 1 further comprises a first holder 81 and a second holder 82 for holding the resilient element 80 in position so as to secure the two ends of the resilient element 80 to bias against the locking arm 61 and the operate wall 51 of the pusher button 50. The first holder 81 is a first spring housing perpendicularly provided on the locking arm 61 to receive the first end of the resilient element 80 and the second holder 82 is a second spring housing perpendicularly provided on the operating wall 51 of the pusher button 50 to receive the second end of the resilient element 80.

Referring to FIG. 4 of the drawing, in order to ignite the childproof barbecue lighter 1, an adult user's must move the locker device 6 from the normal locking position to the unlocked position by sliding the lock button 60 to drive the locking arm 61 to move away from the stopper 70, i.e. the side wall 43 of the piezoelectric unit 40. The user has to apply holding force to the lock button 60 so as to retain the locker device 6 in such unlocked position and then, at the same time, the user must further apply a downward pushing force to push down the pusher button 50 to compress the piezoelectric unit 40 for striking sparks and ignite the barbecue lighter 1.

When the pushing force applied on the pusher button 50 is released, the compressed piezoelectric unit 40 will rebound to its original condition which pushes the pusher button 50 back to its original position. Automatically, the compressed resilient element 80 will also rebound and push the locking arm 61 back to its original locking position.

What is claimed is:

1. A childproof barbecue lighter, comprising:

a casing having a liquefied gas cavity a nd a pusher cavity provided therein;

a liquefied gas container being received in said liquefied gas cavity to provide liquefied gas through a gas emitting nozzle mounted on top of said liquefied gas container;

an elongated nozzle tube extended from said casing and contains a gas tube therein, wherein said gas tube is extended from said gas emitting nozzle to a distil end of said elongated nozzle tube to form an ignition tip;

a piezoelectric unit, which is disposed in said pusher cavity of said casing for generating piezoelectricity, comprising a movable operating part extended therefrom and a spark generating tip which is extended to said distil end of said elongated nozzle tube to produce sparks towards said ignition tip to ignite said gas emitted from said ignition tip;

a pusher button which is disposed in said pusher cavity of said casing in a vertically movable manner and attached on said movable operating part of said piezoelectric unit so as to operatively connect to said piezoelectric unit, wherein said pusher button is also operatively connected to said gas emitting nozzle via a gas lever; and a locker device being installed inside said pusher cavity of said casing for blocking up said pusher button in a downward movable manner so as to lock up said pusher button for ignition, wherein said locker device comprises a lock button being movably supported on said pusher button which has a through slot provided thereon, said lock button being slidably fitted in said through slot in such a manner that said lock button is movable with respect to the pusher button, said lock button further comprising a locking arm integrally and downwardly extended into said pusher cavity through said through slot in such a manner that said lock button is arranged to drive said locking arm to move from a normally locking position to an unlocked position, a stopper which is provided in said pusher cavity and positioned right under said locking arm of said locker device while said locker device is in said locking position so that said locker device is blocked by said stopper for any downward movement so as to stop said pusher button from any downward movement by blocking up said locking arm of said locker device, and a resilient element, which is disposed in said pusher cavity, for applying an urging pressure against said locking arm, so as to normally retain said locker device at said locking position, wherein at said locking position, said locking arm is downwardly extended and stopped by said stopper for blocking up said pusher button from being pushed downwardly so as to lock up said pusher button from ignition, and that at said unlocked position, said locking arm is moved offset from said stopper such that said pusher button is capable of being pushed downwardly to ignite said childproof barbecue lighter.

2. A childproof barbecue lighter, as recited in claim 1, wherein said stopper is a side wall of said piezoelectric unit which is positioned right below said pusher.

3. A childproof barbecue lighter, as recited in claim 2, wherein said locking arm has a predetermined length and is extended downwardly enough from said lock button until a bottom end of said locking arm reaches a top edge of said side wall of said piezoelectric unit, so that said side wall substantially blocks up any downwardly movement of said locker device as well as said pusher button.

4. A childproof barbecue lighter, as recited in claim 3, wherein said resilient element is a compression spring, which is horizontally disposed in said pusher cavity and is provided between said locking arm and an operating wall of said pusher button, wherein said operating wall is positioned adjacent to said locking arm and arranged for pressing said gas lever while said pusher button is pushed down, wherein said resilient element is biasing against said locking arm and said operate wall of said pusher button by attaching a first end thereof to said locking arm and a second end thereof to said operating wall, thereby said resilient element normally urges and retains said locking arm in said locking position that said bottom end of said locking arm is extended to rest on said top edge of said side wall of said piezoelectric unit, so as to block up any downward movement of said locker device for blocking up said pusher button from being pushed downwardly, so as to lock up said pusher button from ignition.

5. A childproof barbecue lighter, as recited in claim 4, wherein said locker device of said childproof barbecue lighter further comprises a first holder and a second holder for holding said resilient element in position so as to secure said two ends of said resilient element to bias against said locking arm and said operate wall of said pusher button.

6. A childproof barbecue lighter, as recited in claim 5, wherein said first holder is a first spring housing perpendicularly provided on said locking arm to receive said first end of said resilient element and said second holder is a second spring housing perpendicularly provided on said operate wall of said pusher button to receive said second end of said resilient element.

7. A childproof barbecue lighter, as recited in claim 2, wherein said resilient element is a compression spring, which is horizontally disposed in said pusher cavity and is provided between said locking arm and an operating wall of said pusher button, wherein said operating wall is positioned adjacent to said locking arm and arranged for pressing said gas lever while said pusher button is pushed down, wherein said resilient element is biasing against said locking arm and said operate wall of said pusher button by attaching a first end thereof to said locking arm and a second end thereof to said operating wall, thereby said resilient element normally urges and retains said locking arm in said locking position that said bottom end of said locking arm is extended to rest on said top edge of said side wall of said piezoelectric unit, so as to block up any downward movement of said locker device for blocking up said pusher button from being pushed downwardly, so as to lock up said pusher button from ignition.

8. A childproof barbecue lighter, as recited in claim 7, wherein said locker device of said childproof barbecue lighter further comprises a first holder and a second holder for holding said resilient element in position so as to secure said two ends of said resilient element to bias against said locking arm and said operate wall of said pusher button.

9. A childproof barbecue lighter, as recited in claim 8, wherein said first holder is a first spring housing perpendicularly provided on said locking arm to receive said first end of said resilient element and said second holder is a second spring housing perpendicularly provided on said operate wall of said pusher button to receive said second end of said resilient element.

10. A childproof barbecue lighter, as recited in claim 1, wherein said resilient element is a compression spring, which is horizontally disposed in said pusher cavity and is provided between said locking arm and said pusher button.

11. A childproof barbecue lighter, as recited in claim 1, wherein said resilient element is a compression spring, which is horizontally disposed in said pusher cavity and is provided between said locking arm and an operating wall of said pusher button.

* * * * *